US012064071B2

(12) United States Patent
Southall

(10) Patent No.: US 12,064,071 B2
(45) Date of Patent: Aug. 20, 2024

(54) SQUEEZE MOP

(71) Applicant: VALE MILL (ROCHDALE) LIMITED, Rochdale (GB)

(72) Inventor: Peter Southall, Rochdale (GB)

(73) Assignee: VALE MILL (ROCHDALE) LIMITED, Rochdale (GB)

( * ) Notice: Subject to any disclaimer, the term of this patent is extended or adjusted under 35 U.S.C. 154(b) by 166 days.

(21) Appl. No.: 17/154,214

(22) Filed: Jan. 21, 2021

(65) Prior Publication Data

US 2021/0228054 A1 Jul. 29, 2021

(30) Foreign Application Priority Data

Jan. 23, 2020 (GB) ..... 2000989

(51) Int. Cl.

| | |
|---|---|
| ***A47L 13/59*** | (2006.01) |
| ***A47L 13/16*** | (2006.01) |
| ***A47L 13/24*** | (2006.01) |

(52) U.S. Cl.

CPC ..... *A47L 13/59* (2013.01); *A47L 13/16* (2013.01); *A47L 13/24* (2013.01)

(58) Field of Classification Search

CPC ..... A47L 13/59; A47L 13/16; A47L 13/24; A47L 13/258; A47L 13/257; A47L 13/146; A47L 13/253; A47L 13/14

USPC ..... 15/244.4, 119.1, 119.2

See application file for complete search history.

(56) References Cited

U.S. PATENT DOCUMENTS

| | | | | |
|---|---|---|---|---|
| 2,044,075 A * | 6/1936 | Jelenfy | ..... | A47L 13/146 15/119.2 |
| 2,637,059 A * | 5/1953 | Vosbikian | ..... | A47L 13/146 15/119.2 |
| 2,730,743 A * | 1/1956 | Zottola | ..... | A47L 13/146 15/116.2 |

(Continued)

FOREIGN PATENT DOCUMENTS

| | | |
|---|---|---|
| CN | 201595788 | 10/2006 |
| DE | 691 04 702 | 6/1995 |
| KR | 10-0974196 | 8/2010 |

OTHER PUBLICATIONS

AZOMaterials NPL, Silicone Rubber, Sep. 25 2001 (https://www.azom.com/article.aspx?ArticleID=920) (Year: 2001).*

Search Report for GB2000989.0, dated Jul. 17, 2020, 1 page.

*Primary Examiner* — David S Posigian
*Assistant Examiner* — Jacob Adam Montgomery
(74) *Attorney, Agent, or Firm* — NIXON & VANDERHYE

(57) ABSTRACT

A squeeze mop comprises a mop head having a central head region secured relative to a handle and a pair of cleaning pad supports which are pivotally located relative to the central head region and movable towards one another to compress the cleaning pad material therebetween, the mop head further comprising biasing means to rotate the two pad supports away from the position at which the cleaning pad material is compressed between the pad supports, said biasing means comprising an elongate elastomeric element the two ends of which are secured to a respective one of the two cleaning pad supports and wherein the head region comprises a platform section for engagement by the elastomeric element, said platform section being located closer to the handle than the at least one position about which the pad supports are pivotally located relative to the head region.

13 Claims, 9 Drawing Sheets

(56) References Cited

U.S. PATENT DOCUMENTS

| | | | | |
|---|---|---|---|---|
| 2,834,974 | A | 5/1958 | Greenleaf | |
| 2,961,676 | A * | 11/1960 | Michaels | A47L 13/146 15/119.2 |
| 6,370,725 | B1 * | 4/2002 | Carlson | A47L 13/146 15/119.2 |
| 2002/0174502 | A1 | 11/2002 | Cioci | |
| 2004/0134020 | A1 * | 7/2004 | Conner | A47L 9/2852 15/340.2 |
| 2009/0139041 | A1 * | 6/2009 | Weis | A47L 13/146 15/119.2 |
| 2011/0185523 | A1 * | 8/2011 | Chen | A47L 13/20 15/119.1 |

* cited by examiner

SQUEEZE MOP

This application claims priority to GB Patent Application No. 2000989.0 filed 23 Jan. 2020, the entire contents of which is hereby incorporated by reference.

This invention relates to a squeeze mop.

The invention relates in particular, though not exclusively, to a squeeze mop, such as a floor mop, comprising a compressible water absorbent cleaning pad which may be squeezed to remove water therefrom.

Various compression mechanisms are known for effecting deformation and compression of a cleaning pad to remove water or other liquids thereform.

A compression mechanism may be of a type operable forcibly to revert a cleaning pad to an initial, undeformed and uncompressed condition. However a compression mechanism of that type typically is expensive to provide and inconvenient in use. As an alternative the resiliency of the cleaning pad material may be relied upon to return the cleaning pad to an initial, uncompressed condition. A disadvantage of that alternative is that the cleaning pad resiliency often is not sufficient to fully revert the cleaning pad to a condition in which it presents a substantially flat surface for uniformly engaging with and cleaning a flat floor surface.

The present invention seeks to provide a squeeze mop which is economic to produce and which is both reliable and effective in operation.

In accordance with one aspect of the present invention a squeeze mop comprises a handle and a mop head located at the one end of the handle, the mop head comprising a central head region secured relative to handle and a pair of cleaning pad supports pivotally located relative to the central head region for the support of at least one cleaning pad, the two pad supports being movable towards one another to compress the cleaning pad material therebetween and the mop head further comprising biasing means to rotate the two pad supports away from the position at which the material of the cleaning pad is compressed between the pad supports, said biasing means comprising an elongate elastomeric element the two ends of which are secured to a respective one of the two cleaning pad supports and wherein the head region comprises a platform section for engagement by the elastomeric element, said platform section being provided at a position closer to the handle than the at least one position about which the pad supports are pivotally located relative to the head region.

In consequence of said positions of the platform section and the locations of the pad supports relative to the handle, movement of the pad supports towards one another under the action of an applied force will stretch the elastomeric element which in consequence will inherently then tend to move as supports away from one another when the applied force ceases to act.

The elastomeric element may extend continuously over the head region from location with one of the pad supports to location with the other of the two pad supports. Alternatively each elastomeric element may comprise two sections each secured to a pad support and to the head region.

The cleaning pad supports may each be pivotally located relative to the head region by means of an interposed hinge component such as a hinge pin. One hinge component may be employed for each pad support or one hinge pin may pivotally locate the two pad supports. Alternatively the cleaning pad supports may be moulded integrally with the head region, and be integrally connected by a relatively thin and flexible section which acts as a hinge.

The squeeze mop may comprise a compression mechanism manually operable to move the two pad supports towards one another thereby to compress the cleaning pad material.

The compression mechanism may comprise, additional to said elongate elastomeric element, a biasing means such as a mechanical coil spring whereby the mechanism is inherently biased to a position at which it does not compress the cleaning pad material.

The compression mechanism need not be, and preferably is not, secured directly to the pad supports. The compression mechanism may be of a kind which slidingly bears against the pad supports to move the pad supports towards one another.

The mop head may comprise a single cleaning pad which is supported by and secured to each of the pad supports, the pad thereby being deformed from an initial shape and compressed as the pad supports are pivotally moved towards one another.

Alternatively the mop head may comprise a plurality of cleaning pads. Each pad support may have a single or a plurality of cleaning pads secured thereto.

The or each cleaning pad may be removable from the pad supports, for example to enable a worn or heavily soiled pad to be replaced by a new cleaning pad or a cleaning pad of a different type.

A cleaning pad may comprise a compressible material, such as hydrophilic foam, secured to a support backing which in turn is releasably secured to a pad support. If the mop head is provided with a single cleaning pad, preferably that cleaning pad is secured to two support backings which are respectively releasably secured to the two pad supports.

Each pad support may define a cavity in which the elongate elastomeric biasing means is located and secured in position. Preferably that cavity is covered at least in part and more preferably is substantially wholly covered by the backing of a cleaning pad of a type comprising compressible cleaning pad material secured to a support backing. In consequence the support backing of the cleaning pad isolates the cleaning pad material from frictional contact with the elastomeric element.

The biasing means may comprise a single elongate elastomeric element.

The elastomeric element may be provided with at least one aperture and at least one of the pad supports is provided with a retention protrusion for location of the elastomeric element.

The elastomeric element may comprise a second location aperture for location with a retention protrusion provided either by the other of the two pad supports or the central head region of the mop head.

The elongate elastomeric element preferably is of a substantially rectangular shape. Typically it may have a length of between 8 cm and 15 cm. The width of the element typically will be between 2 cm and 3 cm.

Preferably the length to width ratio of the elastomeric element is less than 8:1, more preferably less than or equal to 5:1.

The thickness of the elastomeric element will typically be between 1 mm and 5 mm.

Each end region of the rectangular elastomeric element preferably is provided with at least two spaced apart location apertures for securing the end region of the element to a respective one of the pad supports. The apertures at an end region preferably are spaced apart by at least 40% of the width of the elastomeric element.

Each aperture of the rectangular elastomeric element preferably is dimensioned so as to locate with a respective retention protrusion provided by the pad supports. The retention protrusions may be moulded integrally with plastics material of the pad supports. At least one of the protrusions may be of an L shape whereby a distal end of the protrusion extends in a direction away from the position at which the pad support is pivotally located relative to the head region, thereby to assist in retaining the elastomeric element in position on the protrusions.

Although the elastomeric element may be a single element of rectangular shape, that is not essential. Thus each pad support may comprise a pair of protrusions spaced apart in the direction of the axis about which the pad support is pivotally mounted and two elongate elastomeric elements may be provided each to extend between a respective one of the protrusions of one pad support and a respective one of the protrusions of the other pad support. Said two elastomeric elements may each be provided with apertures to co-operate with the protrusions for location and retention of the elastomeric elements. In a further alternative, the two elastomeric elements extending between the respective pairs of protrusions may be integral with one another, for example in the form of a continuous loop of elastomeric material.

In a further alternative there may be two elastomeric elements, each extending to protrusions on a head portion, and to protrusions on their respective pad supports, so as to act independently of each other.

Suitable materials for the elongate elastomeric element include silicone rubber. Suitable materials for the head region, pad supports and pad backing supports include polypropylene, polyoxymethylene and polystyrene.

One embodiment of the present invention will now be described, by way of example, with reference to the accompanying drawings in which:—

Figure 1:
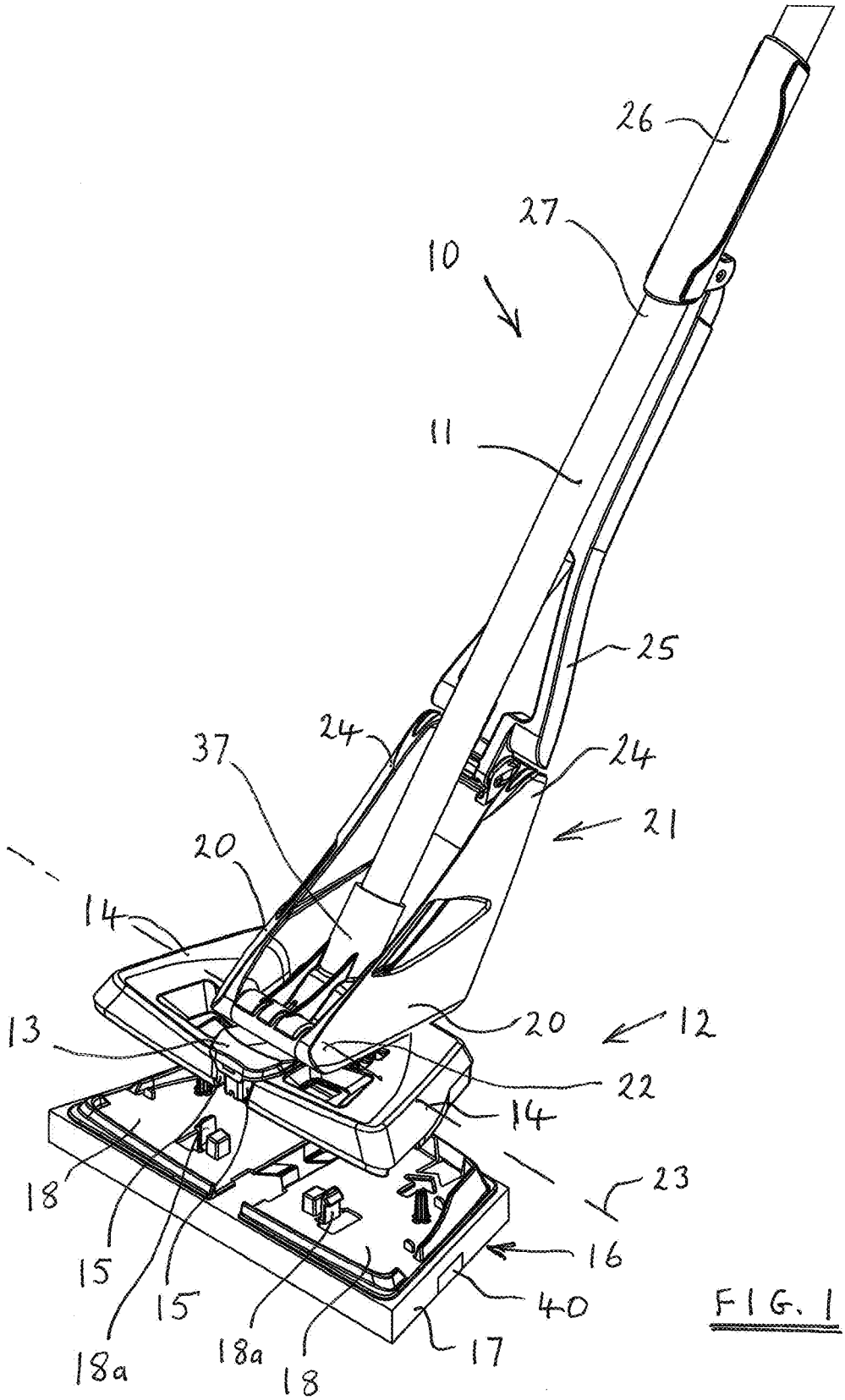
FIG. 1 is a perspective view of part of a mop in accordance with the present invention, with a cleaning pad and associated support backing shown slightly separated from the mop head.

A squeeze mop 10 (see FIGS. 1 and 1A) comprises a handle 11 in the form of a pole to which is secured a mop head 12.

The mop head comprises a head portion 13 to which a pair of cleaning pad supports 14 are pivotally mounted about respective hinge pin axes 15.

The pad supports 14 have secured thereto a cleaning pad unit 16 comprising a single compressible hydrophilic sponge 17 secured to a pair of relatively rigid support backings 18.

Figure 1A:
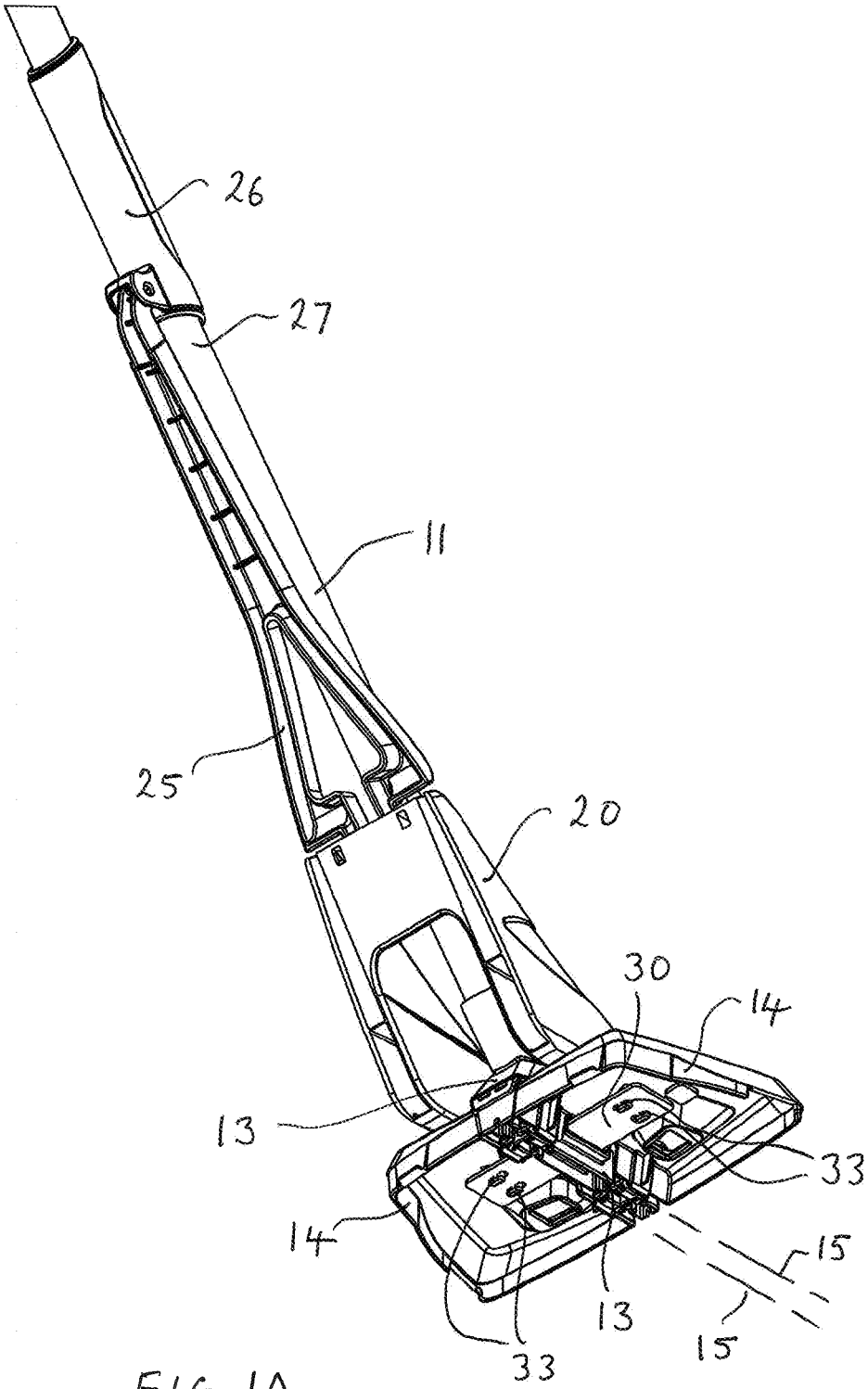
FIG. 1A is a view of part of the mop of FIG. 1 in a second direction and with the cleaning pad removed to reveal the elastomeric element.

The sponge backings 18 are provided with protrusions 18*a* which enable the cleaning pad unit 16 to be secured to the pad supports 14 and also be to removed and replaced in a click-fit manner. The cleaning pad may be of a simple construction of a layer of the aforedescribed sponge 17 secured to the substantially rigid support backings 18 or it may incorporate a strip of scourer material 40 which may be embedded in the sponge material as shown in FIG. 1 or which may, in common with the foam, be secure directly to the sponge support backings 18.

Accordingly the facility for ease of replacement of the cleaning pad unit allows the optional use of different types of cleaning pads.

The head portion 13 additionally has secured thereto a pair of deflector components 20 of a compression mechanism 21 for pivotal movement of the pad supports to move them towards one another for compression therebetween of the sponge 17.

One end region 22 of the deflector component 20 is pivotally mounted on the head portion 13 for pivotal movement about an axis 23 which lies perpendicular to pad support axes 15 and perpendicular to the length of the handle 11.

Figure 2A:
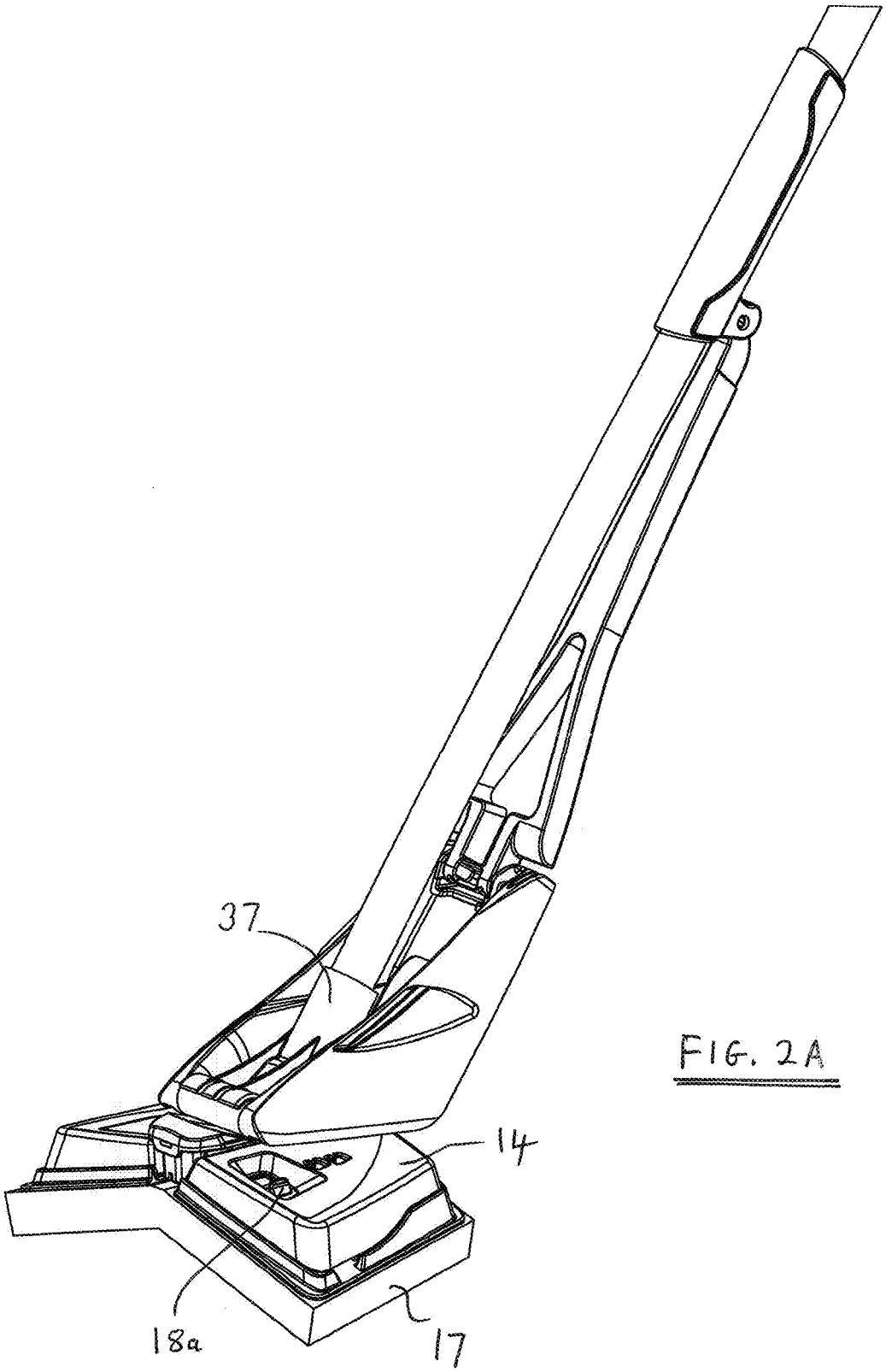
FIGS. 2A, 2B and 2C show stages in operation of the mop of FIG. 1 to compress the cleaning pad.
Figure 2B:
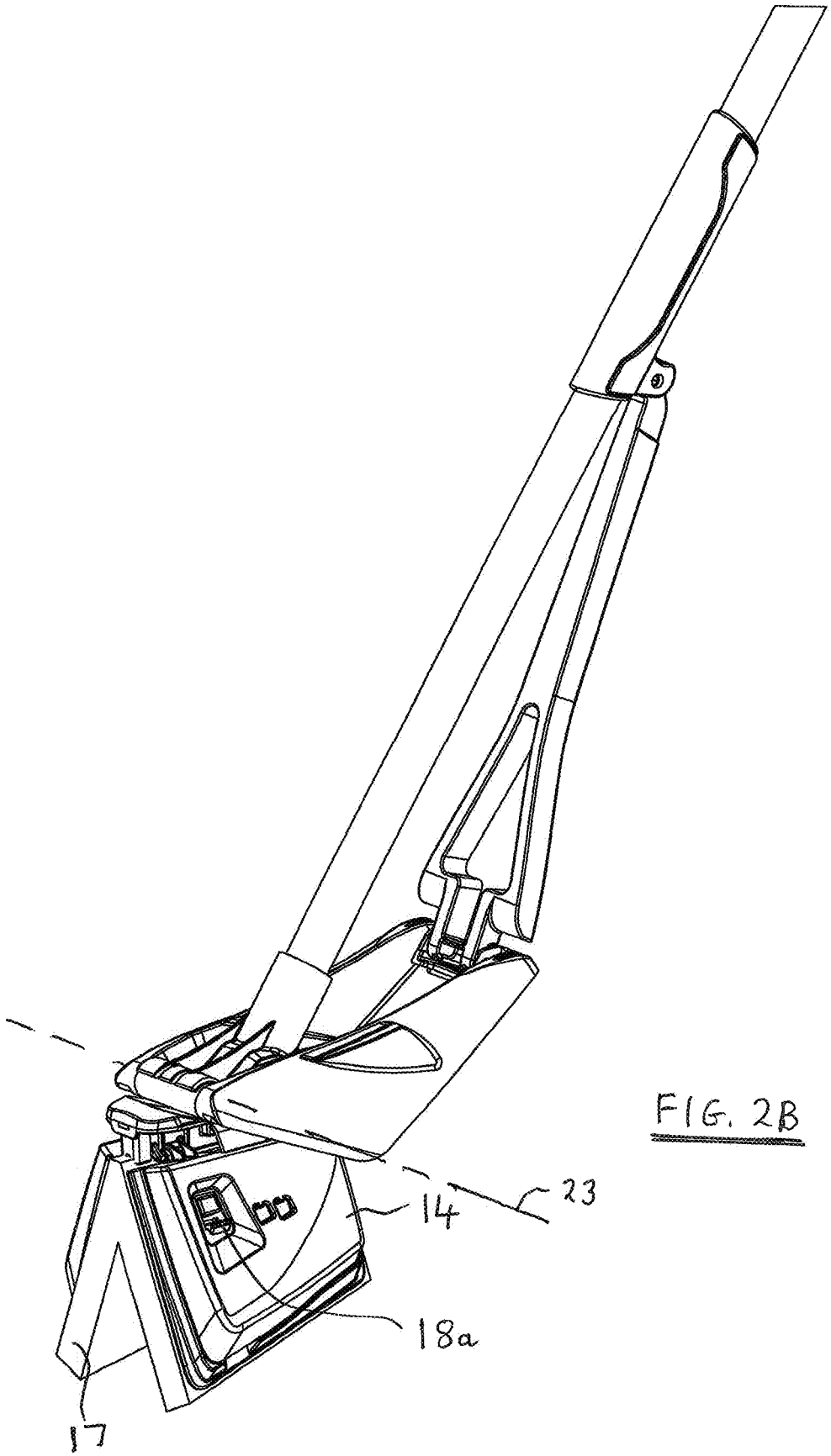

The other end region 24 of the deflector is pivotally secured to an operating arm 25 that is slidably secured by means of a sleeve 26 to a mid-length section 27 of the handle. Movement of the operating arm in a downwards direction towards the mop head 12 results in the deflector component 20 progressively bearing against and rotating the pad supports in a manner shown in FIGS. 2A and 2B until coming to rest at the position shown in FIG. 2C with the pad supports substantially parallel with one another and the sponge 17 firmly compressed therebetween.

Figure 2C:
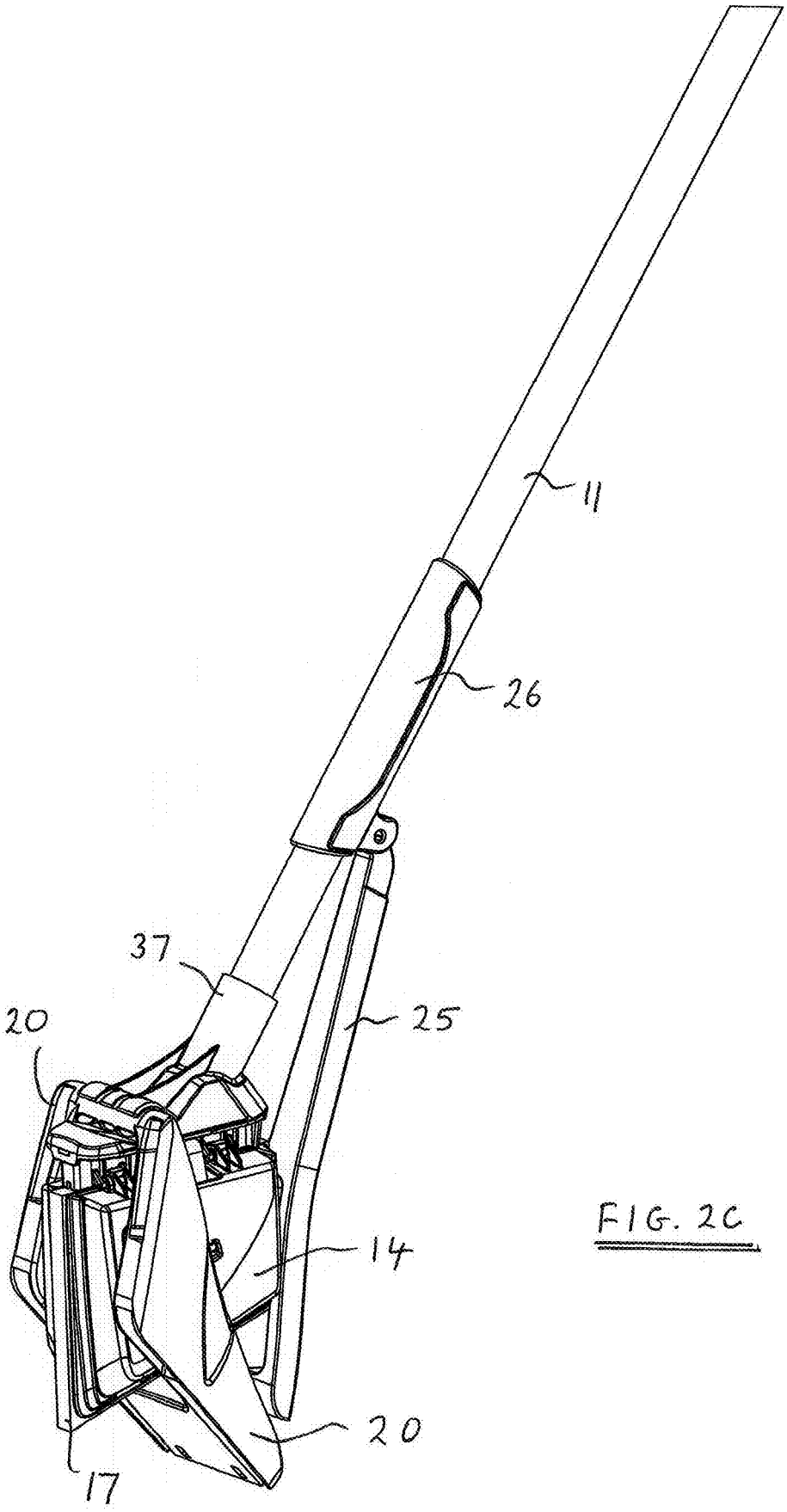

When the operating arm is moved upwards from the position of FIG. 2C to that of FIG. 1 the pad supports are returned to the orientation of FIG. 1 under the action of a biasing component which is located within the mop head.

Figure 3:
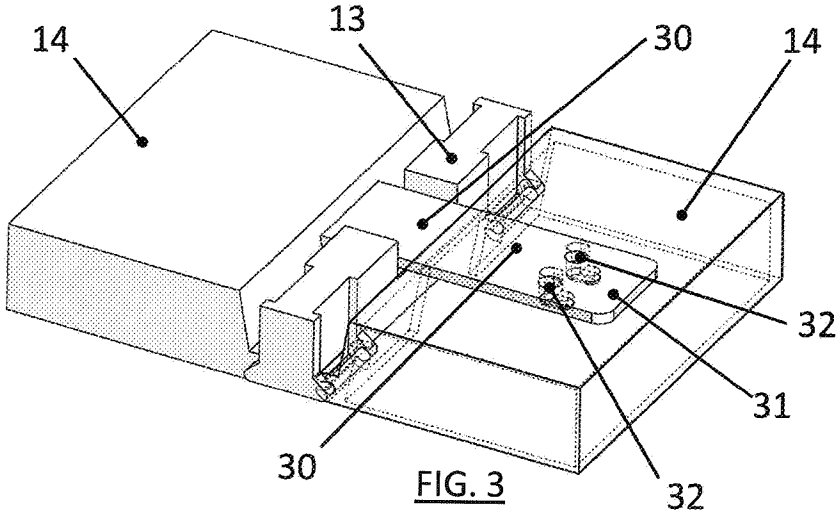
FIG. 3 shows in diagrammatic form, in a part cut away perspective view, a part of the mop of FIGS. 1 and 2.
Figure 5:
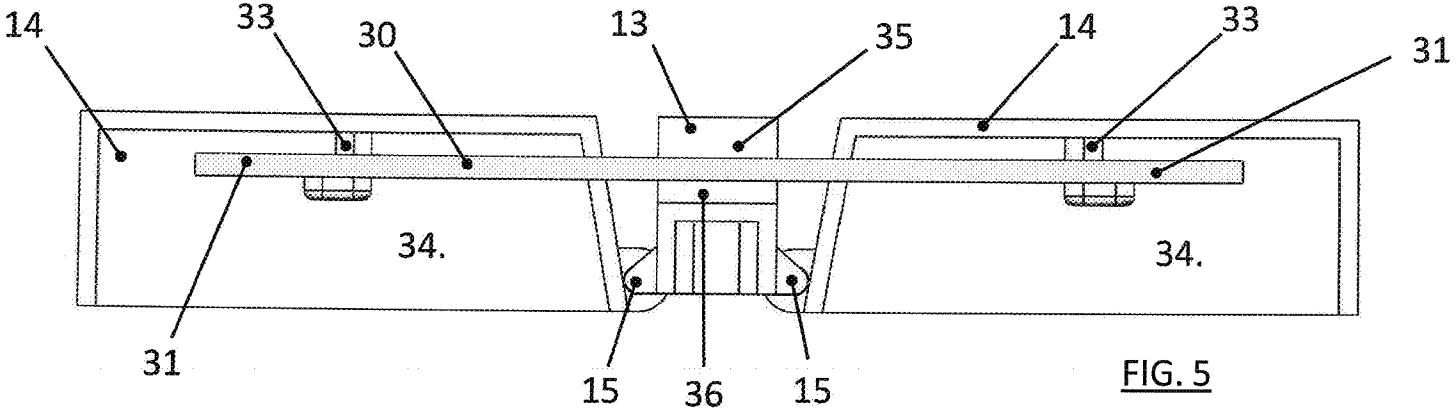
FIG. 5 is a view in the direction of arrow X of FIG. 4.
Figure 6:
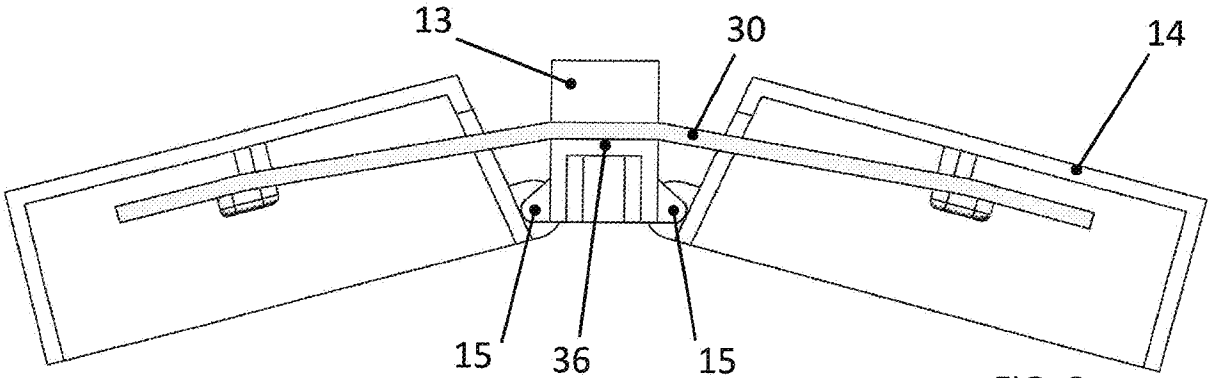
FIGS. 6 to 9 show variations of FIG. 5 in successive positions of the pad supports up to the closed condition of FIG. 9.
Figure 7:
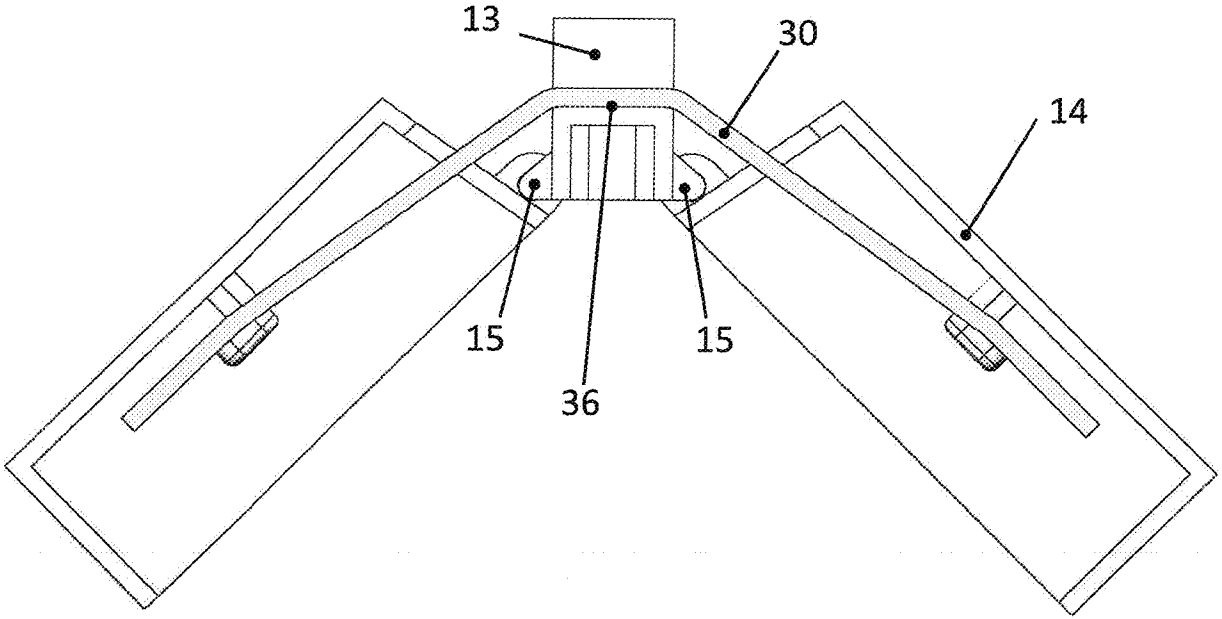
Figure 8:
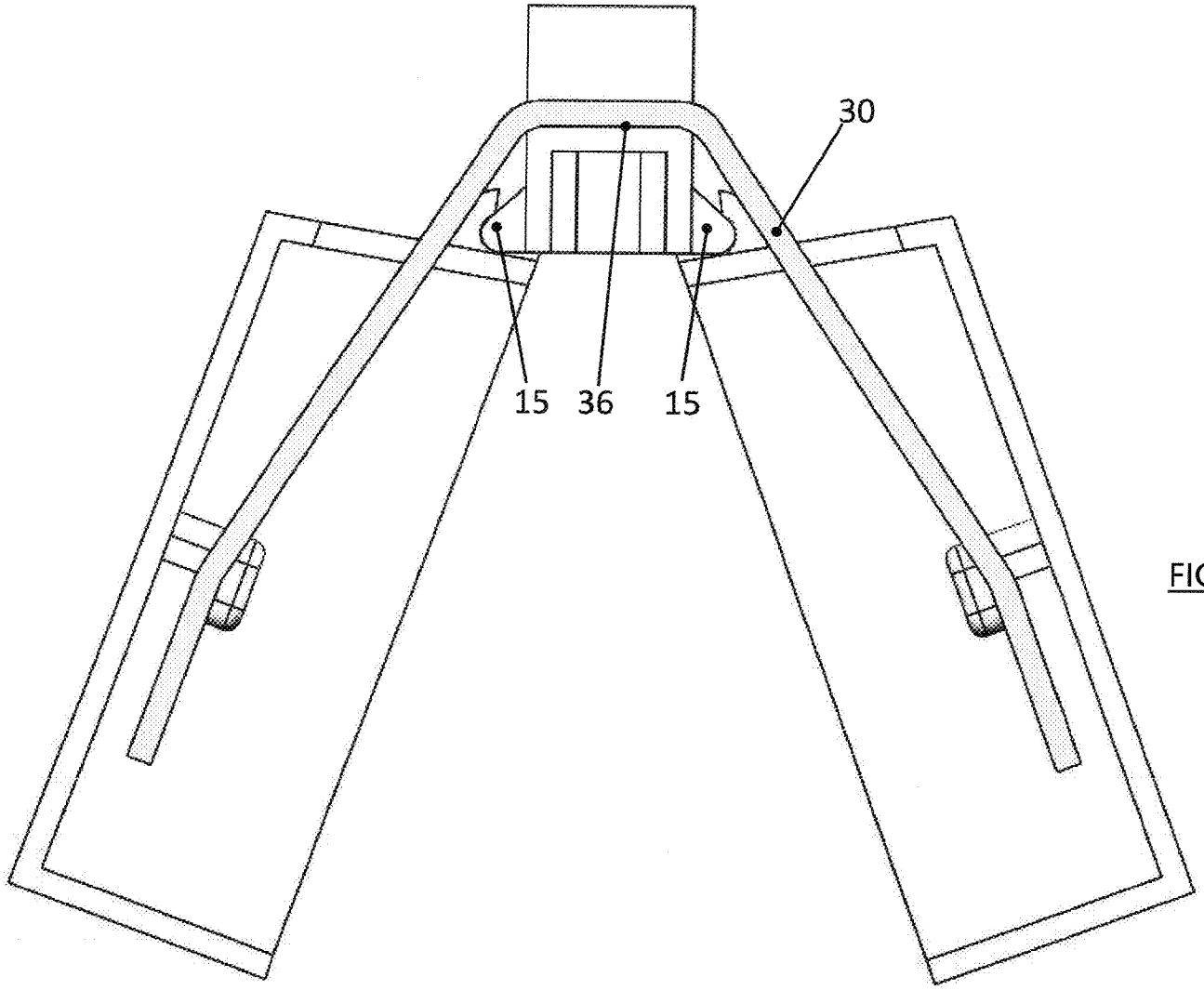
Figure 9:
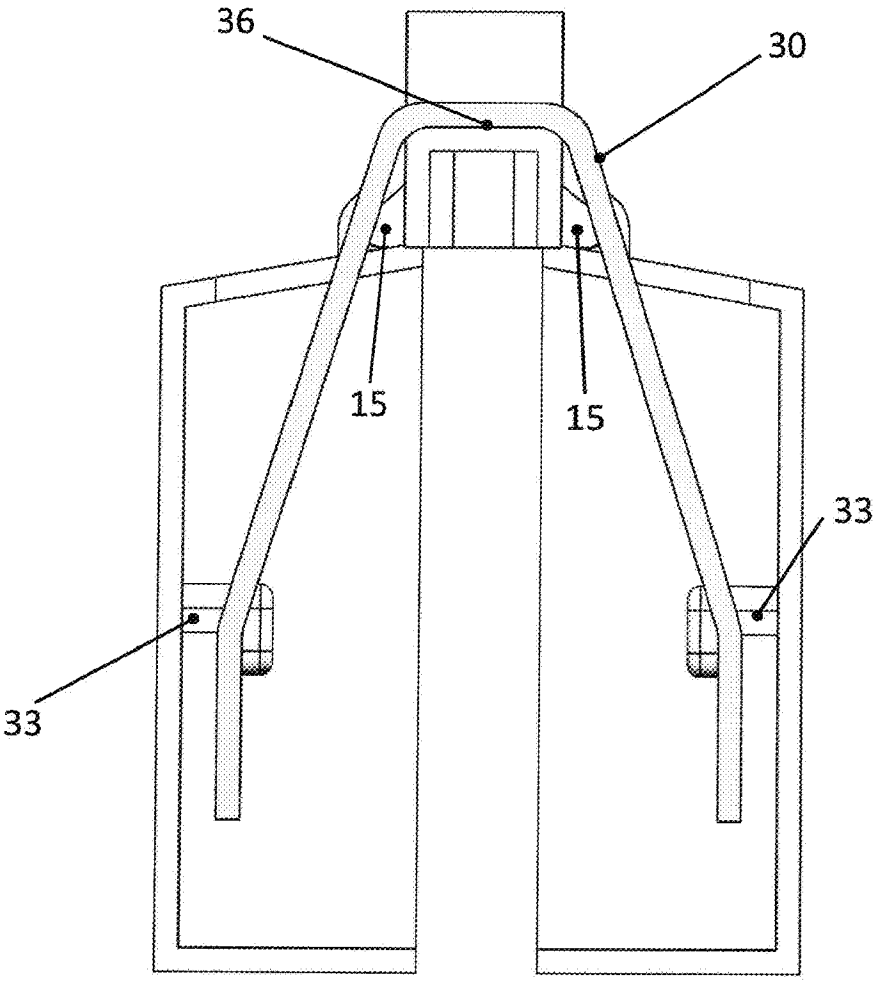
Figure 10:
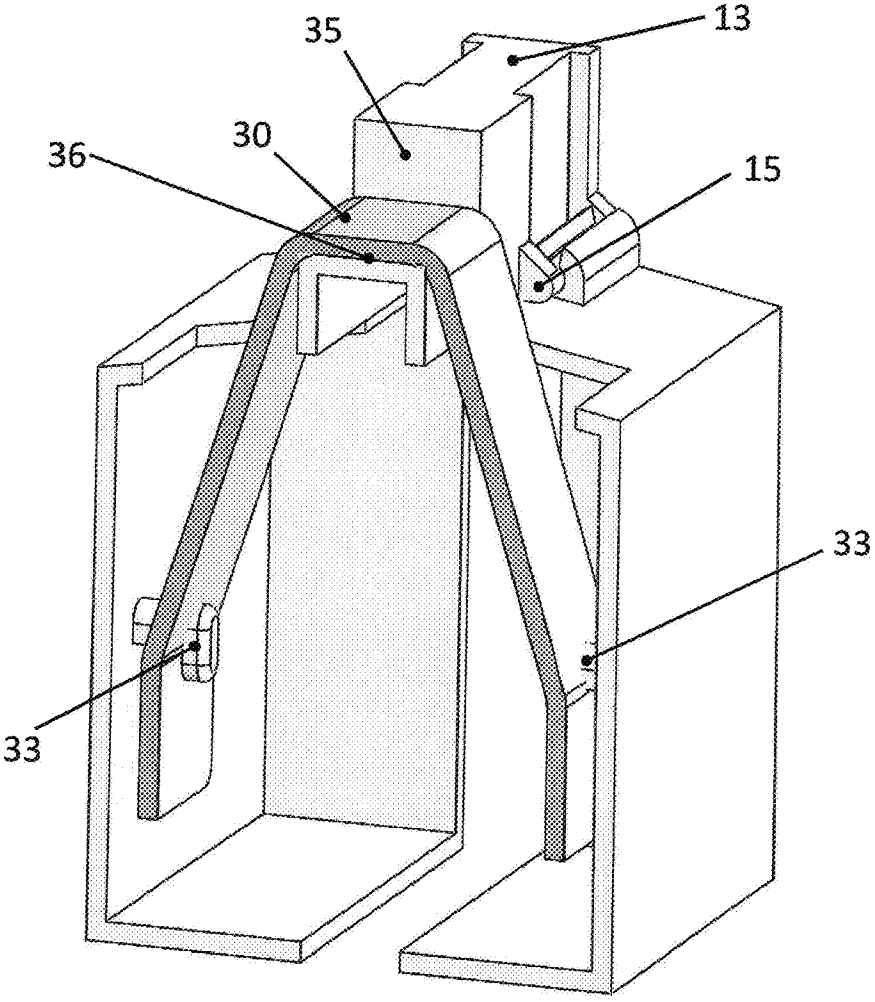
FIG. 10 is a diagrammatic perspective view of part of the mop head when in the closed condition.

For clarity in description of the biasing component and functioning thereof reference is now made to the diagrammatic views of FIGS. 3 to 10, these being devoid of certain constructional features shown in FIGS. 1 to 3 but focusing on details related to functioning of the biasing component.

In this embodiment of the invention the biasing component is an elongate elastomeric band 30 of silicone rubber. Each end region 31 of the band is formed with a pair of location apertures 32 which locate with respective L shaped projections 33 that are formed integrally with the pad supports, positioned in the cavities 34 defined by the pad supports. The spacing of the pairs of apertures in the two pad supports is greater than that of the apertures 32 at the respective end regions of the band when the band is unstretched. Thus when the band is fitted to the projections it is in a stretched condition that, in the absence of externally applied force, inherently tends to retain the pad supports in the relative position shown in FIG. 4.

Figure 4:
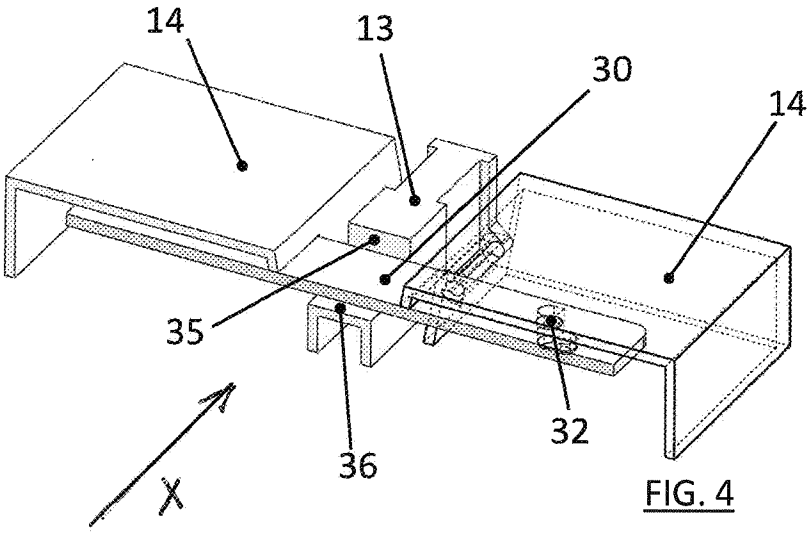
FIG. 4 shows half of the assembly of FIG. 3.

The head portion 13 of the mop head is shaped to provide a recess 35 which, when the supports are in the position shown in FIG. 4, allows the elastomeric band to extend in a straight line, undeflected, between the locating projections 33.

A feature of the head portion recess 35 is that it defines a platform section surface 36 which is positioned closer than the pivot axes 15 to the part 37 of the head portion that is attached to the handle 11.

When the compression mechanism 21 is operated to move the two pad supports 14 closer together, the elastomeric band moves downwards to sit on the platform surface 36 as shown in FIGS. 6 to 10. Because the platform surface is spaced from the pivot axes 15 the band is progressively stretched resulting in the band storing additional energy.

Accordingly when the compression mechanism 21 is lifted or automatically moves in a direction away from the mop head the energy stored in the elastomeric band is able to return the pad supports to the original, undeflected position as shown in FIG. 1 and FIGS. 3 to 5.

In consequence of providing biasing means comprising an elongate elastomeric element there is achieved the provision of a squeeze mop which is both economic to produce and reliable and effective in operation. Furthermore the elastomeric element advantageously provides the further feature of corrosion resistance.

The invention claimed is:

1. A squeeze mop, comprising:

a handle;

a mop head located at one end of the handle, the mop head comprising a central head region secured to the handle, first and second cleaning pad supports configured to support at least one cleaning pad, the first and second cleaning pad supports being configured to pivot about at least one pivot location on the central head region, the first and second cleaning pad supports being movable towards one another to compress the cleaning pad therebetween, the first and second cleaning pad supports being provided with respective retention protrusions, the cleaning pad supports being plastic moldings integrally molded with the retention protrusions, and a biasing device configured to urge the first and second cleaning pad supports to rotate away from a position at which the cleaning pad is compressed between the cleaning pad supports, said biasing device comprising an elongate elastomeric element having opposing first and second ends respectively secured to respective ones of the first and second cleaning pad supports, the elongate elastomeric element being provided with apertures, the respective retention protrusions of the first and second cleaning pad supports being configured to engage with the apertures of the elastomeric element, the central head region comprising a platform section configured to be engaged by the elastomeric element, said platform section being located closer to the handle than the at least one pivot location about which the cleaning pad supports are configured to pivot relative to the central head region; and a compression mechanism manually operable to move the cleaning pad supports towards one another thereby to compress the cleaning pad, the compression mechanism being configured to slidingly bear against the cleaning pad supports to move the cleaning pad supports towards one another, wherein each cleaning pad support defines a cavity configured to engage with and secure the elongate elastomeric element in position, the first and second ends of the elastomeric element extending respectively into respective cavities of the first and second cleaning pad supports, the first end extending through at least half a width of the cavity of the first cleaning pad support, and the second end extending through at least half a width of the cavity of the second cleaning pad support.

2. The mop according to claim 1, wherein the elastomeric element is provided with a first aperture of the apertures, and the first cleaning pad support is provided with one of the retention protrusions configured to engage with the first aperture of the elastomeric element.

3. The mop according to claim 2, wherein the elastomeric element is further provided with a second aperture of the apertures configured to engage with another one of the retention protrusions provided by the second cleaning pad support.

4. The mop according to claim 1, wherein an end region of the elastomeric element is provided with two apertures, located at a same position along a length of the elastomeric element and spaced-apart in a width direction of the elastomeric element, to secure said end region of the elastomeric element to one of the first and second cleaning pad supports.

5. The mop according to claim 1, wherein at least one of the retention protrusions is of a L shape having a distal end which extends in a direction away from the at least one pivot position at which the cleaning pad supports are pivotally located relative to the central head region.

6. The mop according to claim 1, wherein each cleaning pad support is individually pivotally located relative to the central head region, whereby the cleaning pad supports are pivotable about respective positions that are spaced apart from one another on the central head region.

7. The mop according to claim 6, wherein each cleaning pad support is molded integrally with the central head region and is connected to the central head region by a relatively thin and flexible section which permits pivotal movement.

8. The mop according to claim 1, wherein the compression mechanism comprises another biasing device additional to said elongate elastomeric element, whereby the compression mechanism is biased to a position at which the compression mechanism does not compress the cleaning pad.

9. The mop according to claim 1, wherein the elastomeric element extends continuously from a location of the first cleaning pad support at the first end of the elastomeric element to a location of the second cleaning pad support at the second end of the elastomeric element, a mid-section of the elastomeric element, located between the location of the first cleaning pad support and the location of the second cleaning pad support, extending over the central head region.

10. The mop according to claim 9, wherein the platform section presents a platform section surface, which is contacted by the elastomeric element when the elastomeric element is deflected as the cleaning pad supports move to the position at which the cleaning pad is compressed, and wherein the elastomeric element is undeflected when the cleaning pad supports are at a retracted position at which the cleaning pad is not subject to compression.

11. The mop according to claim 1, wherein each cleaning pad comprises compressible cleaning pad material and a support backing secured thereto, the support backing configured to cover the cavity of the cleaning pad support such that, when the cleaning pad support is engaged with the elongate elastomeric element, the cleaning pad material is isolated from contact with the elongate elastomeric element.

12. A squeeze mop, comprising:

a handle; and a mop head located at one end of the handle, the mop head comprising a central head region secured to the handle, first and second cleaning pad supports configured to support at least one cleaning pad, the first cleaning pad support being configured to pivot about a first pivot axis at a first pivot location on the central head region, the second cleaning pad being configured to pivot about a second pivot axis at a second pivot location on the central head region, the first and second pivot locations being spaced from one another, the first and second cleaning pad supports being movable towards one another to compress the cleaning pad therebetween, the first and second cleaning pad supports being provided with respective retention protrusions, the cleaning pad supports being plastic moldings integrally molded with the retention protrusions, and a biasing device configured to urge the first and second cleaning pad supports to rotate away from a position at which the cleaning pad is compressed between the cleaning pad supports, said biasing device comprising an elongate elastomeric element having opposing first and second ends respectively secured to respective ones of the first and second cleaning pad supports, the elongate elastomeric element being provided with apertures, the respective retention protrusions of the first and second cleaning pad supports being configured to engage with the apertures of the elastomeric element, the central head region comprising a platform section configured to be engaged by the elastomeric element, said platform section being located closer to the handle than the first and second pivot locations about which the cleaning pad supports are configured to pivot relative to the central head region; and a compression mechanism manually operable to move the cleaning pad supports towards one another thereby to compress the cleaning pad, the compression mechanism being configured to slidingly bear against the cleaning pad supports to move the cleaning pad supports towards one another, wherein each cleaning pad support defines a cavity configured to engage with and secure the elongate elastomeric element in position, wherein the first and second ends of the elastomeric element extend in a direction perpendicular to a direction of the first and second pivot axes, and wherein the elastomeric element is located centrally between a forward edge and a rearward edge of the first and second cleaning pad supports.

13. A squeeze mop, comprising:

a handle; and a mop head located at one end of the handle, the mop head comprising a central head region secured to the handle, first and second cleaning pad supports configured to support at least one cleaning pad, the first and second cleaning pad supports being configured to pivot about at least one pivot location on the central head region, the first and second cleaning pad supports being movable towards one another to compress the cleaning pad therebetween, the first and second cleaning pad supports being provided with respective retention protrusions, the cleaning pad supports being plastic moldings integrally molded with the retention protrusions, and a biasing device configured to urge the first and second cleaning pad supports to rotate away from a position at which the cleaning pad is compressed between the cleaning pad supports, said biasing device comprising an elongate elastomeric element having opposing first and second ends respectively secured to respective ones of the first second cleaning pad supports, the elongate elastomeric element being provided with apertures, the respective retention protrusions of the first and second cleaning pad supports being configured to engage with the apertures of the elastomeric element, the central head region comprising a platform section configured to be engaged by the elastomeric element, said platform section being located closer to the handle than the at least one pivot location about which the cleaning pad supports are configured to pivot relative to the central head region; and a compression mechanism manually operable to move the cleaning pad supports towards one another thereby to compress the cleaning pad, the compression mechanism being configured to slidingly bear against the cleaning pad supports to move the cleaning pad supports towards one another, wherein each cleaning pad support defines a cavity configured to engage with and secure the elongate elastomeric element in position, and wherein an end region of the elastomeric element is provided with two apertures, located at a same position along a length of the elastomeric element and spaced-apart in a width direction of the elastomeric element, for securing said end region of the elastomeric element to one of the first and second cleaning pad supports.

* * * * *